United States Patent [19]

Lödige

[11] 4,349,280

[45] Sep. 14, 1982

[54] CONTINUOUSLY OPERATING MIXER FOR LOOSE OR AND FLOWABLE MATERIAL

[75] Inventor: Wilhelm Lödige, Paderborn, Fed. Rep. of Germany

[73] Assignees: Fritz Lödige, Paderborn; Josef Lücke, Lichtenau, both of Fed. Rep. of Germany; part interest to each

[21] Appl. No.: 236,125

[22] Filed: Feb. 19, 1981

[30] Foreign Application Priority Data

Feb. 21, 1980 [DE] Fed. Rep. of Germany ..... 3006438

[51] Int. Cl.[3] ..... B01F 15/02

[52] U.S. Cl. ..... 366/183; 406/92

[58] Field of Search ..... 366/101, 102, 150, 154, 366/163, 165, 183, 196, 195, 136, 137; 406/92, 105, 137, 138

[56] References Cited

U.S. PATENT DOCUMENTS 2,148,998 2/1939 Sackett ..... 366/101 X 3,273,863 9/1966 Lödige et al. ..... 366/101

4,006,887 2/1977 Engels ..... 366/102

*Primary Examiner*—Philip R. Coe

*Assistant Examiner*—Joseph M. Pitko

*Attorney, Agent, or Firm*—Becker & Becker, Inc.

[57] ABSTRACT

A continuously operating mixer for loose or flowable material. The mixer includes a cylindrical mixing drum, a shaft which rotates in the drum and is provided with mixing instruments, a feeding or supply device with an inlet chute, and structure to deflect or reverse the incoming material to be mixed in the direction of the axis of the mixing drum, which in an end region thereof has a mixed material discharge. A nozzle-like air inlet channel, which conveys a compressed air flow, opens into the lower region of the inlet chute; an injection channel is connected to the air inlet channel and is directed toward the inlet opening of the mixing drum; this injection channel is flow-connected with an air suction channel which faces away from the inlet opening of the mixing drum; and these channels are consecutively subjected to the air flow of at least one blower.

14 Claims, 4 Drawing Figures

CONTINUOUSLY OPERATING MIXER FOR LOOSE OR AND FLOWABLE MATERIAL

The present invention relates to a continuously operating mixer for loose or flowable material, and includes a cylindrical mixing drum, a shaft which rotates in the drum and is provided with mixing instruments, a feed or supply device with an inlet chute, and means for deflecting or diverting the arriving material to be mixed in a direction toward the axis of the mixing drum, which has a discharge for the mixed material in its end region.

Mixers of this type are suitable for mixing a great variety of materials, including small and very small particles, for instance fibers of synthetic material, lignin cellulose containing materials, granulate, chip particles, and the like. These mixers are generally simultaneously equipped with a device for wetting the material to be mixed with fluids or liquids, for example softeners, water, glue, adhesive, or the like. The supply or feeding of the fluid or liquid can occur either from the outside by way of small tubes which pass through the cylinder wall of the mixer, or can occur from the inside by way of the central drive shaft.

With known mixers of this type, strong impact or crushing effects of the material to be mixed occur in the region of the inlet zone (or in a ring-forming zone which is present with ring or rotary mixers) since this material to be mixed must be picked up at great speed from the essentially tangential direction of entry by the instruments which rotate at high speed with the mixer shaft, and must be deflected and accelerated into an essentially axial direction, i.e. in the longitudinal direction of the cylindrical mixer drum. If a so-called ring or rotary mixer is used, then the material must be deflected or reversed in such a way that if possible directly behind the inlet opening of the material into the cylindrical mixer drum there can be formed a rapidly rotating ring of material to be mixed on the inner wall of the mixer drum. The mixer tools or instruments, which with the known mixers rotate in the region of the inlet and ring-forming zones, impact or strike the incoming material to be mixed at great speed. The material to be mixed is consequently subjected to strong exterior and interior friction, particularly to undesired impact and crushing stress. As a result, destruction of the structure of the particles of material to be mixed occurs, which is disadvantageous with certain materials, for example synthetic material granulates of prescribed particle size, fibers, chip particles, etc., since such changes or destruction of the particle structure can lead to an unacceptable reduction of quality of the end product, for example with the production of chip or particle board. If the material to be mixed is to be wetted with liquid or fluid, for example glue or adhesive, an undesirably high glue or adhesive consumption occurs as a consequence of the enlargement of the surface of the particles to be mixed.

It is an object of the present invention to embody a mixer of the initially mentioned type in such a way that the loose or flowable material to be mixed, and which is to be introduced into the mixer, is deflected or diverted under the effect of a directed air flow from the incoming direction of the material prescribed by the inlet chute into a direction parallel to the axis of the mixer drum in such a way that the material is guided into the mixer drum in the direction of rotation of the instruments arranged on the mixer shaft without destruction of the material structure by crushing or impact action.

This object, and other objects and advantages of the present invention, will appear more clearly from the following specification in connection with the accompanying drawings, in which.

Figure 1:
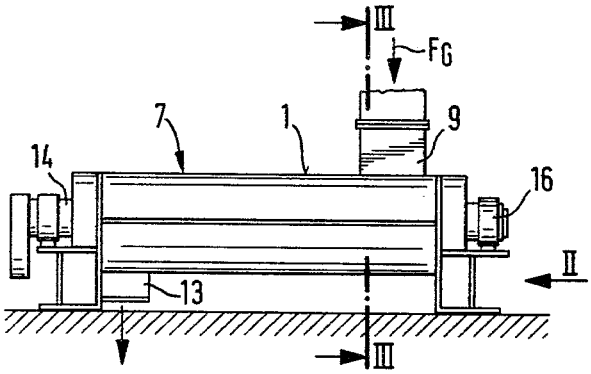
FIG. 1 is a side view of an inventive drum (barrel) mixer having an inlet chute and a material outlet or discharge opening located at the other end of the mixer.

The mixer of the present invention is characterized primarily in that a nozzle-like air inlet channel, which guides a compressed air flow, opens into the lower region of the inlet chute; an injection channel, which is directed toward the inlet opening of the mixing drum, is connected to the air inlet channel; this injection channel is connected aerodynamically or from a flow standpoint with an air-suction channel which faces away from the inlet opening of the mixing drum; and these channels are consecutively subjected to the air flow of at least one blower.

According to further advantageous features of the present invention, the nozzle-like air inlet channel may open into the funnel-shaped, tapered end segment of the inlet chute. The end segment may have a quadrilateral horizontal cross section into which the air inlet channel opens over the entire width of the inlet chute. The injection channel may extend helically in a direction toward the inlet opening of the drum, and may be limited by an appropriately curved deflector or guide plate in such a way that the injection channel opens into the drum in the rotational direction of the mixer shaft. The air-suction channel may be coaxial to the mixer shaft, and may be formed by a pipe or tube which is open toward the inlet opening. The air-suction channel, on that side facing away from the inlet opening, may open into a suction channel connected to the suction side of the blower. An annular diaphragm may be arranged between the suction tube and the wall of the drum in the upper region of the inlet opening.

The discharge opening of the injection channel may terminate in the region of the annular diaphragm, with the injection channel being formed by the outer wall of the suction tube, the inner wall of the mixing drum, and the guide plate, which extends helically forward; preferably, the injection channel is tapered in the manner of a funnel in the direction toward the interior of the drum. At least one blade or paddle, which rotates with the shaft, may, in the direction of flow of the material to be mixed, be arranged after the annular diaphragm and the discharge opening of the injection channel in the direction of the material outlet or discharge opening of the drum.

The pressure side of the blower, for the purpose of branching off a partial air flow into the inlet chute, may be flow-connected with the inlet chute. Nozzles may be arranged in the inlet chute in the region above the funnel-shaped end segment for introducing a partial compressed-air flow. Air-guide plates may be arranged in the region of and behind the nozzle in such a way that the compressed-air flow coming from the blower is guided into the rounding or curvature of the mixing drum after discharge from the injection channel. A closed circuit may be formed by the suction chamber (with the intake connection of the blower), the channel with the nozzle, the injection channel, and the suction channel.

The inventive mixer may be operated in such a way that the particles of the material to be mixed may be accelerated by the compressed air flow in such a manner that in the region of the inlet opening of the injection channel into the drum, these particles have the same peripheral speed as the instruments rotating in the mixer.

By way of the inventive embodiment of the mixer, the material which is to be mixed and which arrives by way of the inlet chute is deflected, guided, and accelerated by compressed air flow, while avoiding the use of mechanically operating tools, for example rotating collecting tools, in such a way that the material enters the mixer in an at least substantially axial direction and in the at least substantially identical rotational direction as the direction of rotation of the instruments in the mixer, without under such circumstances leading to undesired turbulence of the air which guides the material particles and which has been accelerated to the necessary speed of the rotating instruments. Furthermore, by way of the present invention, the previously conventional tools of the so-called collecting zone (collecting tools), which are subjected to continuous wear and are complicated in construction, are made needless and unnecessary. The material to be mixed is consequently no longer subjected to the sufficiently known friction and crushing action which previously led to the undesired destruction of the structure of the particles of the material to be mixed.

Figure 2:
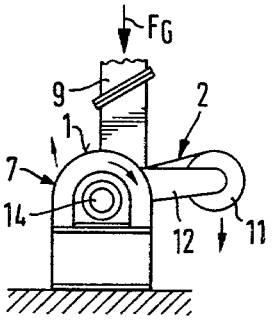
FIG. 2 is a front view of the mixer of FIG. 1.

Referring now to the drawings in detail, the mixer of FIGS. 1 and 2 has a mixing drum 7 which is divided in the middle and has a hinged cover 1 capable of being swung open or raised. A mixer shaft 14 driven by a motor 16 rotates in the cylindrical mixing drum 7. Mixing instruments not illustrated in detail are located on the mixer shaft 14. The material to be mixed drops in the direction of the arrow $F_G$ through an inlet chute 9 which has a preferably quadrilateral horizontal cross section, and has a funnel-shaped end segment 9' in the lower portion thereof. A nozzle-like air inlet channel 2 is inventively provided above the narrowest part of this funnel-shaped end segment 9'. The jet or nozzle 2' of the air inlet passage 2 opens into the inlet chute 9 over the entire width thereof. The compressed or pressurized air flowing through the nozzle-like channel 2 enters over the entire width of the inlet chute 9 at high speed by means of the nozzle or jet 2'. The compressed air mixes with the dropping material to be mixed, and passes into an injection channel 3 which is disposed in the lower part of the drum 7 along the wall 7' of the drum at an incline to the actual inlet opening 15 to the mixing chamber of the drum 7 (see FIG. 4). The arrows $F_L$ in FIGS. 3 and 4 of the drawings show the flow direction of the pressure guided air, and the arrows $F_G$ represent the direction of movement of the material particles within the pressure air flow. As is apparent from FIG. 3, the material particles $F_G$ shown in the section of FIG. 3 and represented by points surrounded by circles, move forwardly out of the plane of the drawing. As a consequence of the fact that the injection channel 3 inventively extends toward the drum inlet opening 15 in a helical path and is limited rearwardly by an appropriately bent deflector or guide plate 6, there results that the injection channel 3 opens into the drum 7 in the rotational direction of the mixer shaft 14, and accordingly in the rotational direction of the instruments, particularly a blade or paddle 8, arranged on the mixer shaft 14 (see FIG. 4).

Figure 3:
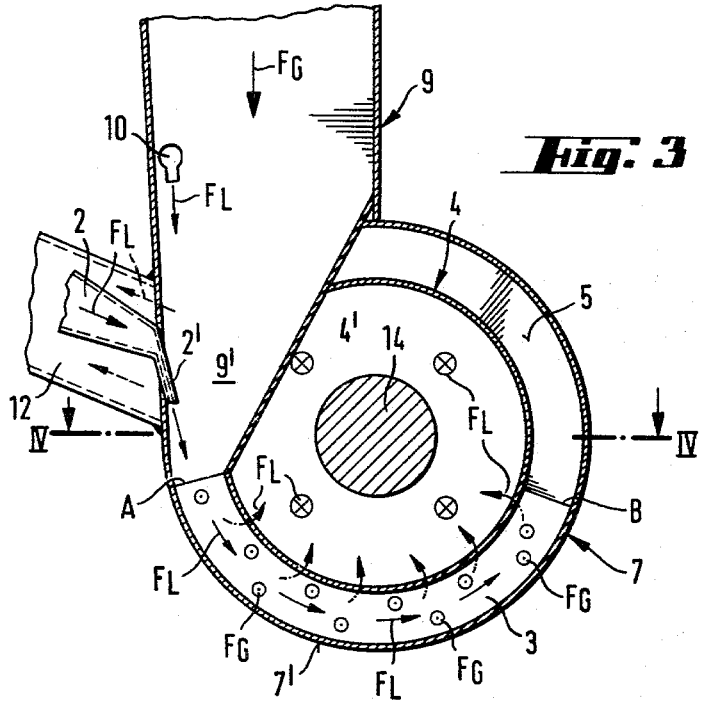
FIG. 3 is a section taken along line III—III of FIG. 1.
Figure 4:
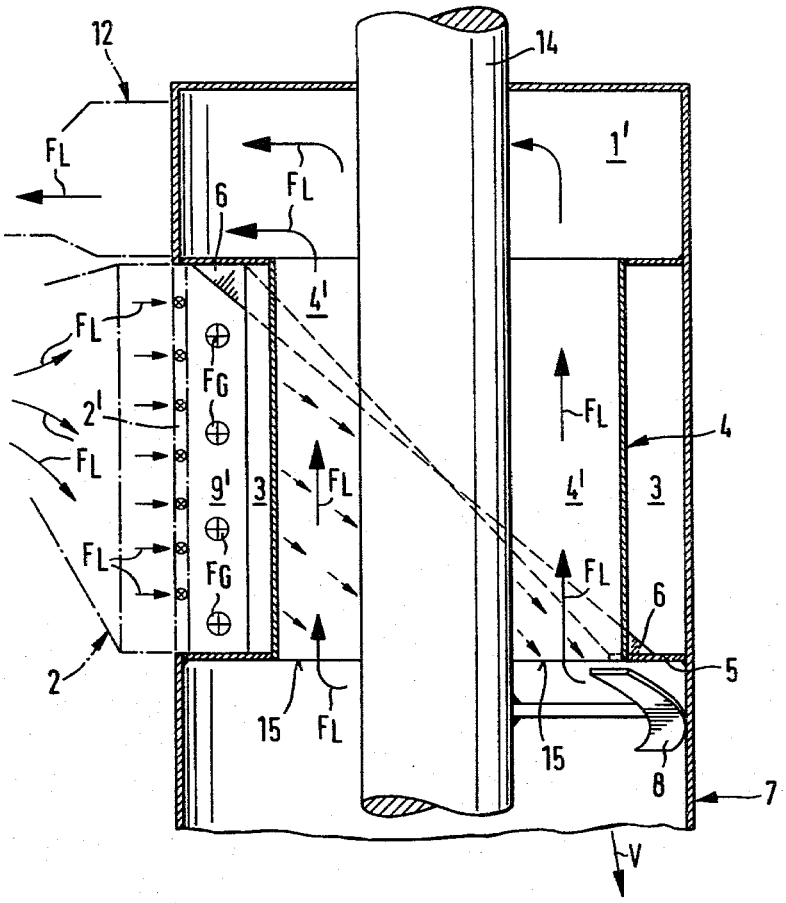
FIG. 4 is a section taken along line IV—IV of FIG. 3.

The material dropping in the inlet chute 9 is broken up or loosened by the air stream entering by way of the nozzles 2', and accordingly passes together with the compressed air through the nearly helical, forwardly directed injection channel 3, at the front end of which the material, as a consequence of the direction and speed obtained hereby, discharges axially into the mixing drum 7 with a speed which approximates the rotating speed of the rotating paddle 8. Consequently, crushing or impacts of the material, which comprises solid particles, is avoided upon collision with the rotating paddle 8 and the remaining instruments which are fastened to the shaft 14. The injection channel 3 is limited inwardly toward the shaft 14 by a suction tube 4 which coaxially surrounds the shaft 14. This suction tube 4 surrounds an air-suction channel 4' which extends inside the suction tube 4, coaxial with the mixer shaft, from the inlet opening 15 rearwardly in conformity to the direction of the arrows $F_L$ and opposite to the direction of movement V of the particles of material to be mixed. The air leaving the injection channel 3 is reversed or deflected by 180° in this suction passage 4' as a consequence of the strong suction effect of the blower or fan 11, so that a whirling of this air within the actual drum 7 is avoided, and accordingly an undesired influencing of the particles of material entering this drum 7 is avoided. According to FIG. 3, the air, in conformity to the arrows $F_L$, flows within the helical injection channel 3, which is directed forwardly toward the mixer drum, is accordingly sharply reversed or deflected in the region of the front end-segment of the suction tube 4, and is accordingly hindered from a further flowing into the drum region. The air flows along the direction of the arrows $F_L$ coaxially to the shaft 14 into a suction chamber 1' (see FIG. 4), from which the air flow passes to the blower 11, and from there, by way of the suction or intake connection 12, back into the circuit to the nozzle-like channel 2, and, by way of the nozzle 2', again to the injection channel 3. In FIG. 3, the flow of the air within the suction tube 4 is indicated with symbols (x in a circle). The curved arrows $F_L$, in the direction toward the shaft 14, show the air flow in the region of the front end face of the tube 4 at the reversing or deflecting location.

The air-suction channel 4', on that side facing away from the inlet opening 15, opens into the suction chamber 1', which is connected to the suction side of the blower 11.

A diaphragm ring 5 is arranged between the suction tube 4 and the wall of the drum 7 in the upper region of the inlet opening 15 toward the mixing drum 7; the diaphragm ring 5 reduces the suction cross section and prevents a penetration of particles of material to be mixed into the suction chamber 1' located before the intake connection 12. The air flows back to the blower 11 in conformity with the arrows $F_L$ shown in FIG. 4, and from there the air flows from the pressure side of the blower back into the nozzle-like channel 2, and by way of the nozzle 2' into the injection channel 3. As a consequence of the arrangement of the annular diaphragm 5, the opening A of the injection channel 3, which is formed by the outer wall of the suction tube 4, the inner wall of the mixing drum 7, and the guide plate 6 which extends helically forwardly, terminates in the region B of the annular diaphragm 5. Furthermore, when viewed in the direction of flow of the material to be mixed, at least one blade or paddle 8, which rotates with the shaft 14, is provided after the annular diaphragm 5 and the opening of the injection channel 3 in the direction of the material outlet or discharge opening 13. The paddle 8 picks up the arriving material particles and brings them into a desired helical rotational movement, which is directed toward the material discharge 13, along the inner wall of the drum 7.

The pressure side of the blower 11 is advantageously flow-connected with the inlet chute 9 by way of a connecting channel for the purpose of branching off or diverting a partial air flow into the inlet chute 9. Jets or nozzles 10 (see FIG. 3) are advantageously provided at the opening location of this connecting channel. These nozzles 10 open directly above the funnel-shaped end segment 9' into the inlet chute 9 in the direction of the arrow shown in FIG. 3, i.e., in a downward direction. Consequently, there already occurs a first loosening of the material in a downward direction toward the inlet opening of the injection channel 3, so that blocking of the material in the region of the restricted or narrowed cross section 9' of the inlet chute 9 is substantially avoided.

According to a further embodiment of the present invention, provision is made so that the air flow of the blower 11 is guided in the region of the nozzle 2' by air-guiding plates (not illustrated in detail) in such a way that the compressed air flow $F_L$ coming from the blower 11 is guided into the curvature of the mixing drum 7 after discharge from the injection channel 3.

As already set forth, the suction chamber 1' with the intake connection 12 to the blower 11, the channel 2 with the nozzle 2', the injection channel 3, and the suction channel 4' form a closed circuit, so that the air discharging from the pressure side of the blower 11 continuously arrives with a desired high speed, by way of the nozzle-like channel 2 and the nozzle 2', after mixing with the material particles, into the injection channel 3, which extends in a funnel-like manner and helically winds in the rotational direction of the instruments 8 into the drum 7, from where the material particles enter the drum 7 in a controlled direction and, as a consequence of the arrangement of the suction tube 4 in connection with the diaphragm 5, are separated from the compressed air flow, which is suctioned off in the opposite direction by means of the channel 4'. The arriving material to be mixed is then taken over by the instrument 8 and is further transported in the direction toward the discharge 13. Due to the special arrangement of the suction tube 4 concentrically with the shaft 14, the air is suctioned only in the vicinity of the shaft and, because of the centrifugal effects of the rotating mixing instruments, in a region free of mixing material.

The air volume and the flow speed of the air can be controlled or regulated, in conformity to the particular conditions of the material to be mixed, by a suitable device, for example a throttle valve. As a result, the particles of material to be mixed are accelerated by the air flow to such an extent that the speed of the particles themselves corresponds approximately to that of the rotating instruments 8 seated on the shaft 14. The helical movement of the mixture presses the material to be mixed, with only minimal speed differences between the material to be mixed and the instruments 8, into the drum 7 of the mixer, without under such circumstances having the material particles subjected to destructive crushing forces or impact forces. The front view of the mixer illustrated in FIG. 2 schematically shows the blower 11, the intake connection 12, as well as the injection connection leading from the blower 11 to the channel 2. Accordingly, it is seen that the blower 11 can advantageously be embodied as a counterweight for the hinged upper part of the mixer cover.

The present invention is, of course, in no way restricted to the specific disclosure of the specification and drawings, but also encompasses any modifications within the scope of the appended claims.

What I claim is:

1. A continuously operating mixer for loose or flowable material, said mixer comprising:

a cylindrical mixing drum, which at a first end region thereof is provided with an inlet opening for material to be mixed, and at a second end region thereof is provided with an outlet for mixed material;

a mixer shaft which rotates in said drum and is provided with mixing instruments;

a feed device located in the vicinity of said first end region of said drum and having an inlet chute, with a lower end segment, for delivering said material to be mixed;

a nozzle-like air inlet channel for guiding a flow of compressed air, said air inlet channel opening into said lower end segment of said inlet chute;

an injection channel, which is directed toward said inlet opening of said mixing drum, said injection channel communicating with said lower end segment of said inlet chute, and with said air inlet channel, for receiving material to be mixed, and compressed air;

means arranged in said injection channel for deflecting incoming material to be mixed toward the axis of said mixing drum;

an air-suction channel which faces away from said inlet opening of said mixing drum, said air-suction channel being flow-connected with said injection channel; and at least one blower associated with said mixing drum for producing an air flow, said air inlet channel, said injection channel, and said air-suction channel being consecutively subjected to the air flow of said at least one blower.

2. A mixer according to claim 1, in which said end segment of said inlet chute is funnel-shaped and tapers toward said injection channel.

3. A mixer according to claim 2, in which said end segment of said inlet chute has a quadrilateral horizontal cross section into which said air inlet channel opens over the entire width of said inlet chute.

4. A mixer according to claim 3, in which said injection channel extends helically toward said inlet opening of said drum, and in which said means for deflecting incoming material to be mixed is an appropriately curved guide plate, said guide plate limiting said injection channel in such a way that said injection channel opens into said drum in the direction of rotation of said mixer shaft.

5. A mixer according to claim 4, in which said air-suction channel is formed by a suction tube which is coaxial to said mixer shaft and is open toward said inlet opening.

6. A mixer according to claim 5, which includes a suction chamber connected to the suction side of said blower, and in which that side of said air-suction channel which faces away from said inlet opening opens into said suction chamber.

7. A mixer according to claim 6, in which said mixing drum includes a wall located radially outwardly of said suction tube, and which includes an annular diaphragm arranged between said suction tube and said wall of said drum in the radially outer region of said inlet opening.

8. A mixer according to claim 7, in which said injection channel has a discharge opening toward the axis of said mixing drum formed by said suction tube, said wall of said mixing drum, and said helically extending guide plate, said discharge opening of said injection channel terminating in the region of said annular diaphragm.

9. A mixer according to claim 8, in which said injection channel is tapered in the manner of a funnel toward the interior of said mixing drum.

10. A mixer according to claim 8, in which said mixing instruments include at least one paddle which rotates with said mixer shaft and, in the direction of flow of said material to be mixed, is arranged after said annular diaphragm and said discharge opening of said injection channel, said at least one paddle being arranged so as to forward material toward said outlet of said mixing drum.

11. A mixer according to claim 10, in which the pressure side of said blower is flow connected with said inlet chute for the purpose of branching off a partial air flow into said inlet chute.

12. A mixer according to claim 11, which includes nozzles arranged in said inlet chute in the region above said funnel-shaped end segment for introducing said partial air flow.

13. A mixer according to claim 12, which includes air-guide plates arranged in the region of, and behind, said nozzle-like air inlet channel in such a way that compressed air flow coming from said at least one blower is guided into the curvature of said mixing drum after discharge from said injection channel.

14. A mixer according to claim 13, in which said at least one blower includes an intake connection on the pressure side thereof, said suction chamber, said intake connection, said air inlet channel, said injection channel, and said air-suction channel forming a closed circuit.

* * * * *